United States Patent [19]

Garris et al.

[11] Patent Number: 4,802,323

[45] Date of Patent: Feb. 7, 1989

[54] AUTOMATED INSPECTION OF CAPSULE SEALS

[75] Inventors: Charles R. Garris, Sewell; Kenneth M. Ruttenberg, Hammonton, both of N.J.; James L. Neiswender, Sr., Philadelphia, Pa.

[73] Assignee: SmithKline Beckman Corporation, Philadelphia, Pa.

[21] Appl. No.: 110,328

[22] Filed: Oct. 20, 1987

[51] Int. Cl.[4] ..... B65B 57/00

[52] U.S. Cl. ..... 53/53; 53/900; 209/524; 209/580

[58] Field of Search ..... 53/53, 900; 156/64, 156/378; 209/524, 580, 644

[56] References Cited

U.S. PATENT DOCUMENTS

| | | | |
|---|---|---|---|
| 3,200,556 | 8/1965 | Ackley | 53/900 |
| 3,368,671 | 2/1968 | Kaeding | 209/644 X |
| 3,618,764 | 11/1971 | Banduniak | 209/580 |
| 3,882,316 | 5/1975 | Garris | 250/560 |
| 3,889,447 | 6/1975 | Garris | 53/53 |
| 3,927,195 | 12/1975 | Messora | 424/21 |
| 3,942,900 | 3/1976 | Garris | 356/237 |
| 3,969,227 | 7/1976 | Garris | 209/73 |
| 4,584,817 | 4/1986 | Yamamoto et al. | 53/329 |

OTHER PUBLICATIONS

One page description by Charles Garris entitled "Missing Registration Hole Detection System".

Drawing dated 11/18/83 entitled "Missing Registration Hole Detection System".

*Primary Examiner*—John Sipos

*Attorney, Agent, or Firm*—Howson & Howson

[57] ABSTRACT

In a capsule-sealing machine comprising a slat conveyor for carrying capsules over liquid binder application wheels and a bucket conveyor for receiving the sealed capsules and carrying them through the air drying chamber, a set of photoelectric inspection heads is positioned adjacent to the slat conveyor, and solenoid valves and air nozzles are positioned adjacent to the bucket conveyor. Signals produced by the inspection heads are delayed, and used to operate the solenoid valves to eject defectively sealed capsules from the bucket conveyor. The inspection heads are carried on a bar supported by brackets having inverted L-shaped slots which allow the bar to be moved upwardly and out of the way so that the slat conveyor can be cleaned or repaired. When the bar is in the inspection position adjacent to the slats, a slot in a lower edge of the bar fits over an adjusting wheel which permits fine adjustment of the positions of the inspection heads relative to the slats. An LED indicator electronically coupled to the inspection heads allows fine adjustment of the position of the inspection head carrier bar during operation of the sealing machine.

11 Claims, 5 Drawing Sheets

AUTOMATED INSPECTION OF CAPSULE SEALS

BRIEF SUMMARY OF THE INVENTION

This invention relates to capsule manufacture and more particularly to automatic apparatus for the inspection of tamper-resistant seals on two-part oblong medicinal capsules.

A large proportion of the pharmaceutical products currently on the market are supplied in two-part hard gelatin capsules. Each capsule consists of a capsule body and an overlapping cap, the body and cap forming an enclosure for the medicament. Recently, pharmaceutical manufacturers have taken steps to prevent tampering with these capsules. One of the most widely used tamper-proofing techniques is to apply a liquid binder to the overlapping joint of the cap and body of the capsule. A typical liquid binder is a heated solution of colored gelatin. When dried, the gelatin forms a distinct, visible band at the location of the capsule joint. Most attempts at tampering are readily apparent because they destroy the continuity of the colored band.

Sealing bands can be applied to capsules by various means. However, one of the more efficient means for applying a sealing band is the Elanco QUALI-SEAL capsule-sealing machine, available from Eli Lily and Company of Indianapolis, Ind. Some of the details of the Elanco capsule-sealing machine are given in Yamamoto et al. U.S. Pat. No. 4,584,817, issued Apr. 29, 1986. The entire disclosure of the Yamomoto et al. patent is here incorporated by reference. The Elanco sealing machine comprises a capsule-rectifying section, a sealing section and a drying section. In the capsule-rectifying section, closed capsules successively supplied to the rectifying means are positioned in a predetermined orientation or posture during the transportation of the capsules from a supply station toward a transfer station. In the sealing section, an endless conveyor, comprising a series of slats drivingly trained between horizontally spaced sprockets, transports the capsules past one or more solution-appyling stations. A solution applicator unit includes a plurality of applicator wheels rotatably supported at the solution-applying station for rotation in planes parallel to the direction of transportation of the closed capsules, and generally perpendicular to the longitudinal sense of each of the closed capsules being successively transported. These wheels apply a sealing solution to the overlapping joint of the closed capsules. Preferably, each slot has a row of equally spaced generally oblong openings extending completely through the thickness of the slat and having a shape similar to the shape of the capsules being handled. These oblong openings accommodate the closed capsules for transportation of the capsules from the transfer station toward a delivery station past the solution-applying station during movement of the slats. The upper run of the slats travels over a grooved bed plate, the grooves and the bed plate providing clearance for the wet bands of sealing solution. Intermediate portions of the openings of the slats are also enlarged to provide clearance for the wet bands.

Although not described in the Yamamoto patent, the Elanco apparatus includes means for transfer of the capsules from the slat conveyor to a bucket conveyor which makes multiple runs through a drying chamber. The drying chamber uses filtered conditioned air at ordinary ambient temperatures to effect drying, thereby preventing loss of capsule moisture content and preventing undesirable effects on heat-sensitive ingredients. The bucket conveyor comprises a series of buckets carried between parallel conveyor chains and pivotally mounted to the chains. The buckets are weighted so that they always remain upright while in the drying chamber, regardless of the direction of travel of the chains.

In the operation of the Elanco capsule-sealing machine, inspection of capsules is carried out visually by an operator. The operator constantly watches capsules as they are carried past the sealing application stage by the slat conveyor. Capsules perceived to have defective seals are removed manually with the aid of a grasping tool similar to tweezers. Visual capsule inspection is not adequately reliable because a human operator cannot pay constant attention to large numbers of capsules moving past at relatively high speed. The extreme noise generated by capsule-sealing machines also makes it unpleasant for an operator to conduct visual inspection for long periods of time.

Capsules can be inspected automatically or visually at later stages in the capsule packaging operation. However, inspection in these later stages often involves the rejection of entire packages of multiple capsules when only one capsule is defective. Furthermore, apparatus heretofore used for capsule inspection has been complex and expensive, and no simple automated inspection apparatus has been made available which is capable of accurately and reliably detecting and rejecting capsules with defective seals. Automated inspection and rejection of capsules in the capsule-sealing machine itself has not been considered practical.

The principal object of this invention is to provide for accurate and reliable inspection and automatic rejection of capsules having defective seals. A further object of the invention is to provide capsule inspection and rejection apparatus which can be incorporated in a capsule sealing and drying apparatus. A still further object of the invention is to provide a reliable inspection and rejection apparatus which is inexpensive and does not require elaborate components. Still a further object of the invention is to provide a reliable inspection and rejection apparatus for a capsule-sealing machine which can be easily adjusted for optimum accuracy and reliability.

In accordance with the invention, inspection of capsules is carried out photoelectrically, preferably by using photoelectric inspection means which direct beams of light toward the capsule seals and respond to reflected light by means of a photoelectric sensor having adjustable sensitivity. Whenever the seal on a capsule passing the inspection beam is sufficiently incomplete, or otherwise sufficiently defective, to cause a variation in reflected light detectable by the photoelectric sensor, a signal is produced which indicates that the capsule is defective. This inspection is carried out while the capsules are being conveyed by the slat conveyor of a sealing machine from the sealing stage to the transfer stage where the capsules are transferred to the bucket conveyor for drying. Because the slat conveyor and the bucket conveyor are synchronized, it is possible for capsules having defective seals to be rejected as they are carried by the bucket conveyor toward the drying chamber. Signals from the photoelectric inspection devices are delayed by a programmable controller which acts as a shift register. The controller is synchronized with the movement of the slat and bucket conveyors, and produces output signals at appropriate times to operate solenoid valves. The valves deliver blasts of air which are directed toward the buckets of the bucket conveyor to remove capsules having defective seals from the buckets. Proper operation of the capsule rejecting means is assured by providing bucket guides which prevent the buckets from swinging under the force of the air blasts as they pass the rejecting apparatus.

At the inspection stage, a plurality of photoelectric inspection heads, corresponding in number to the number of capsule-receiving openings in a slat, are fixed to and supported by a bar which is mounted on brackets so that the inspection heads are located at a proper distance above the slats for optimum operation. The brackets have inverted L-shaped slots which allow the bar and the inspection heads to be moved upwardly and held out of the way when repairs or adjustments to the slats are being carried out. A slot in the bar fits over a manually operable adjusting wheel mounted on one of the brackets. This wheel, by means of threads, allows the bar position to be adjusted from side to side so that the photoelectric inspection heads are properly positioned for optimum operation. An electronic circuit responsive to all of the outputs of the inspection heads causes a light to flash when the inspection heads are out of adjustment, and to glow steadily when the inspection heads are properly adjusted.

Other objects and advantages of the invention will be apparent from the following detailed description.

DETAILED DESCRIPTION

Figure 1:
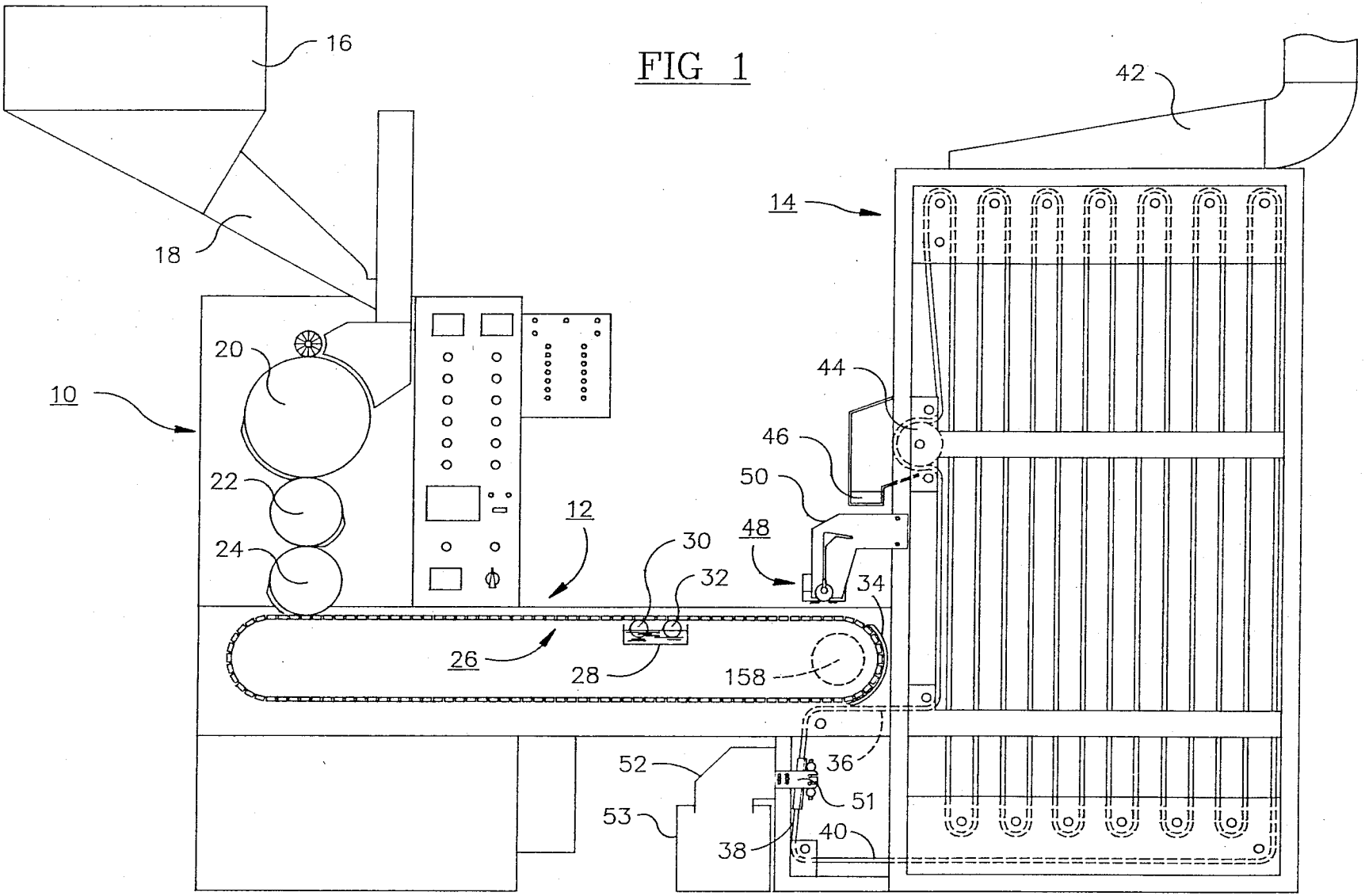
FIG. 1 is a diagrammatic side elevation of a capsule-sealing machine including rectifying, sealing and drying sections, and showing the positions of the inspection and rejection means of the invention.

The capsule-sealing machine, as shown in FIG. 1, comprises three main sections, a capsule-rectifying section 10, a binder application section 12, and a drying section 14.

In the capsule-rectifying section, capsules are delivered from a hopper 16 through a chute 18 toward a feed drum 20. The feed drum is followed by a rectifying drum 22 and a transfer drum 24, the latter delivering capsules to a slat conveyor 26. The manner in which the rectifying section operates is set forth in detail in Yamamoto et al. U.S. Pat. No. 4,584,817.

The slat conveyor comprises an endless series of metal slats which travel in an elongated upper run over a reservoir 28 containing a heated gelatin solution, or other suitable liquid binder. The slats of conveyor 26 carry the capsules, in transversely extending rows of capsule-retaining slots, over applicator discs, which are indicated at 30 and 32. The applicator discs are also provided in transverse rows, there being one applicator disc for each capsule-retaining slot in a slat. In a typical machine, each slat contains seven slots, and accordingly seven applicator discs are provided at each of the two applicator stages. These discs transfer liquid binder from reservoir 28 onto the capsules as they pass over the discs, forming a film of binder in the form of a distinct, visible band at the location of the capsule joint. Preferably, the liquid binder is dyed in a distinct color so that it can be visually distinguished from the other parts of the capsule. The distinct color also aids in photoelectric inspection, as carried out by the inspection means of the invention.

In FIG. 1, as the slats travel toward the right in the upper run, and the slats begin to travel downwardly toward the lower run, they encounter a transfer guide 34. The guide prevents capsules from falling out of the slats, and transfers them to section 36 of a bucket conveyor. The bucket conveyor consists of buckets with capsule-receiving recesses. The buckets are carried between two parallel chains and pivoted to the chains so that the capsule-receiving recesses normally face upwardly regardless of the direction of travel of the buckets. The bucket conveyor has a downwardly travelling section 38, which leads to a horizontal section 40. The horizontal section of the bucket conveyor enters an enclosed chamber of drying section 14. The chamber is fed with dry conditioned air through duct 42. The bucket conveyor travels in an undulating path through chamber 14, and around a circular guide 44 at the left-hand side of the drying chamber. Guide 44 causes the buckets to tip and dump the dried capsules onto chute 46, from which they are delivered to a suitable receptacle (not shown).

An inspection head 48 is supported by a pair of brackets, one of which is shown in FIG. 1 at 50, at a location above the upper run of the slat conveyor between the binder application stage and transfer guide 34. An air valve and nozzle array 51, for ejecting defective capsules, is located adjacent to run 38 of the bucket conveyor. A chute 52 guides ejected capsules into receptacle 53.

Figure 3:
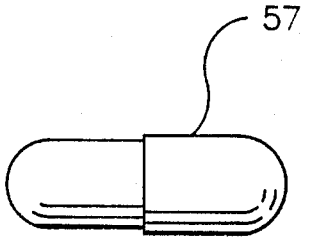
FIG. 3 is an elevational view of a conventional unsealed capsule.
Figure 4:
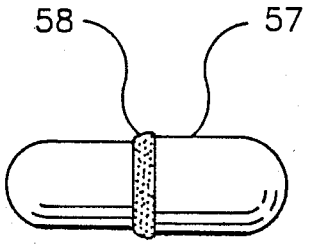
FIG. 4 is an elevational view of a capsule with a sealing band.
Figure 2:
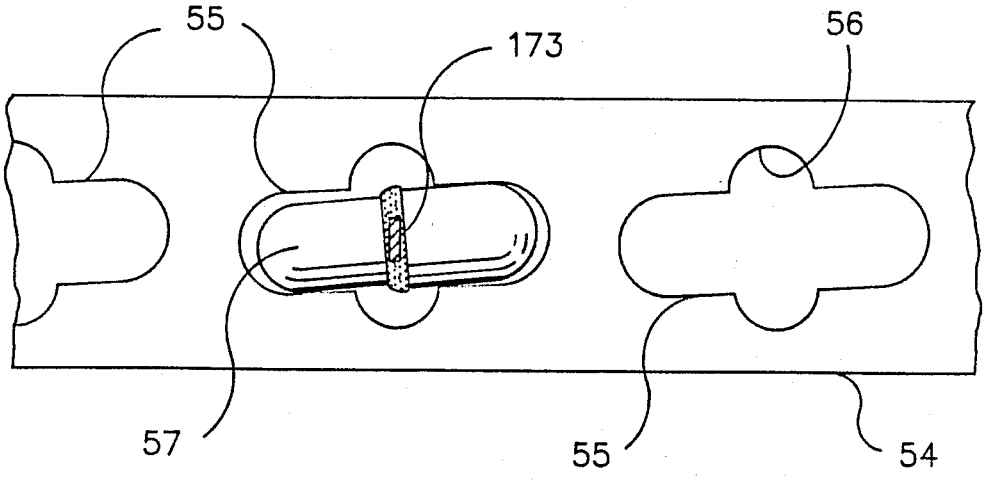
FIG. 2 is a fragmentary top plan view of a slat of the sealing machine's slat conveyor, showing a capsule being carried in the slat and illustrating a rectangular inspection aperture superimposed on the sealing band of the capsule.

FIG. 2 shows part of a typical slat 54 of the slat conveyor. The slat is an elongated metal bar having a row of oblong slots 55 with widened intermediate parts 56. Each of the oblong slots carries a capsule, one capule being shown at 57. The capsule is a conventional capsule, as shown in FIG. 3, having, after it reaches the binder application stage, a wet, ring-shaped seal 58 as shown in FIG. 4.

Figure 5:
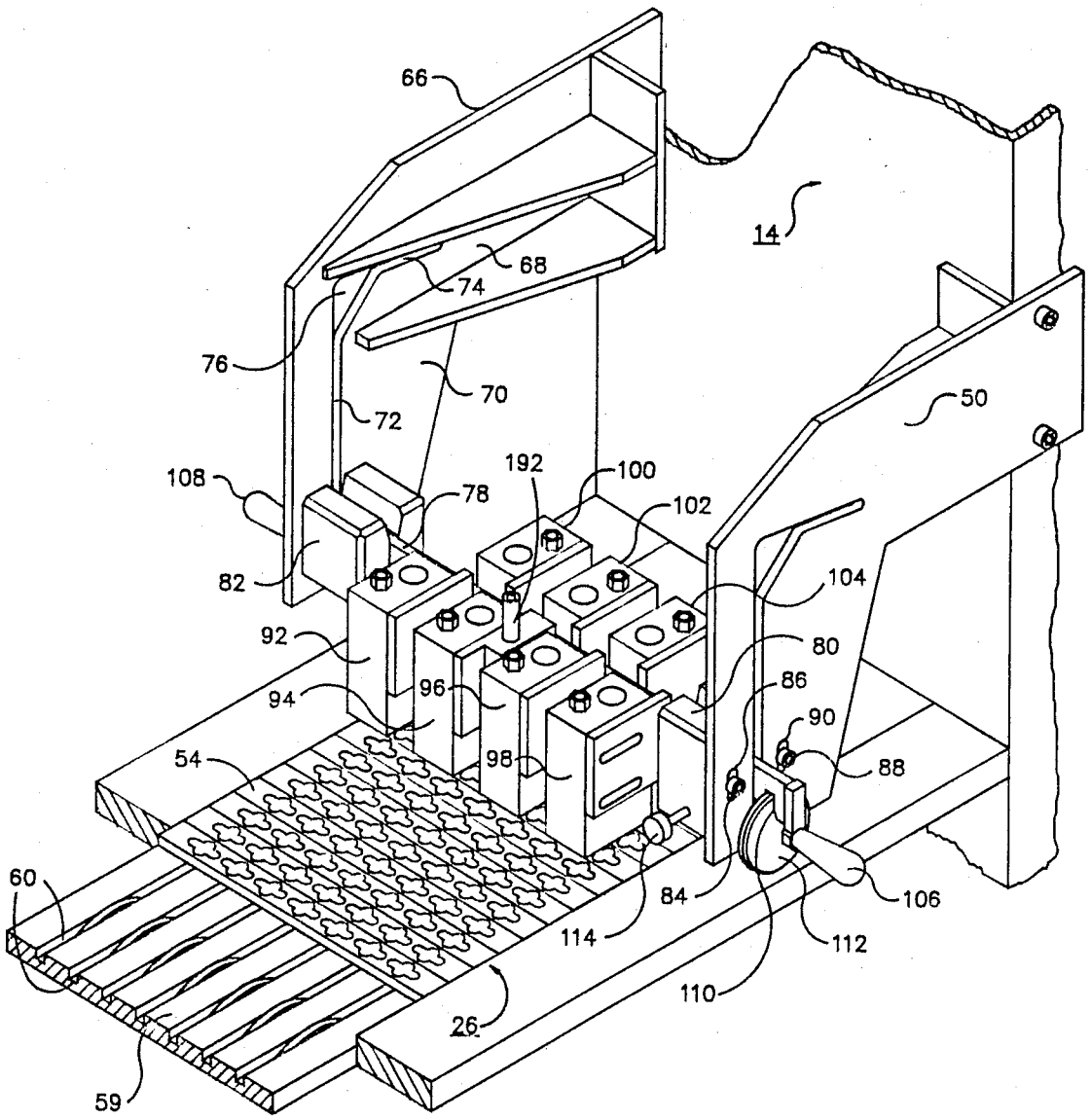
FIG. 5 is a fragmentary perspective view showing the photoelectric inspection head assembly, its supporting brackets, its adjusting means, and a portion of the slat conveyor.

As shown in FIG. 5, the slats, including slat 54, travel over a bed 59 having longitudinal grooves 60. These grooves are aligned with the widened intermediate parts of the capsule-receiving slots so that, as the capsules travel, the bands of wet binder do not contact any parts of the apparatus. The discs by which the bands of binder are applied to the capsules extend through slots (not shown) in the floors of grooves 60.

Brackets 50 and 66, which support the inspection head assembly, are bolted to the housing of drying section 14. Bracket 66 has a downwardly extending leg 70, which has a substantially vertical slot 72, a substantially horizontal slot 74 connected to the upper end of slot 72 through a triangular-shaped opening 76. The vertical leg of bracket 50 has similar slots. A bar 78 extends through the slots of both of the brackets, and is supported in notches in supporting blocks 80 and 82 which are adjustably secured to the brackets by bolts. Block 80 is secured to bracket 50 by bolt 84 in slot 86, and by bolt 88 in slot 90. The slots allow for vertical adjustment of the blocks. Bar 78 supports a first row of inspection heads 92, 94, 96 and 98, and a second row of inspection heads 100, 102 and 104. The inspection heads in the two rows are interleaved in such a way that inspection head 92 is located above the path of the first capsule-receiving slot in a slat, inspection head 100 is located above the second slot, and so on. The two rows of inspection heads are spaced from each other in the direction of conveyor travel by a distance of several slat widths. Even though the inspection heads are so wide that they cannot all be situated in a single row, they are able to accommodate the closely spaced capsule-receiving slots.

Bar 80 has handles 106 and 108 attached at its opposite ends. These handles permit the bar, and the inspection heads which it carries, to be manipulated. The bar can be moved upwardly, rotated and positioned in the substantially horizontal portions of the slots so that the inspection assembly is conveniently held out of the way, permitting repair, cleaning or visual inspection of the slats. Bar 78 has a slot 110 near one of its ends. This slot receives a rotatable wheel 112, which has a threaded shaft (not shown) extending from its center, through a hole in bracket 50, and into a threaded hole in block 80. Rotation of the wheel causes the wheel to move axialy. The wheel fits tightly into slot 110 of bar 78, engaging both vertical sides of the slot to lock the bar against movement transverse to the direction of slat travel. Fine adjustment of the position of the bar is accomplished by manual rotation of wheel 112, which enables the bar to be moved horizontally a short distance in either direction transverse to the direction of slat conveyor movement.

A locking screw 114 is threaded into block 80. This locking screw can be rotated manually so that it bears against the shaft of the wheel 112, whereby preventing adjustment of the wheel and preventing bar 78 from being moved in its lengthwise direction.

Figure 6:
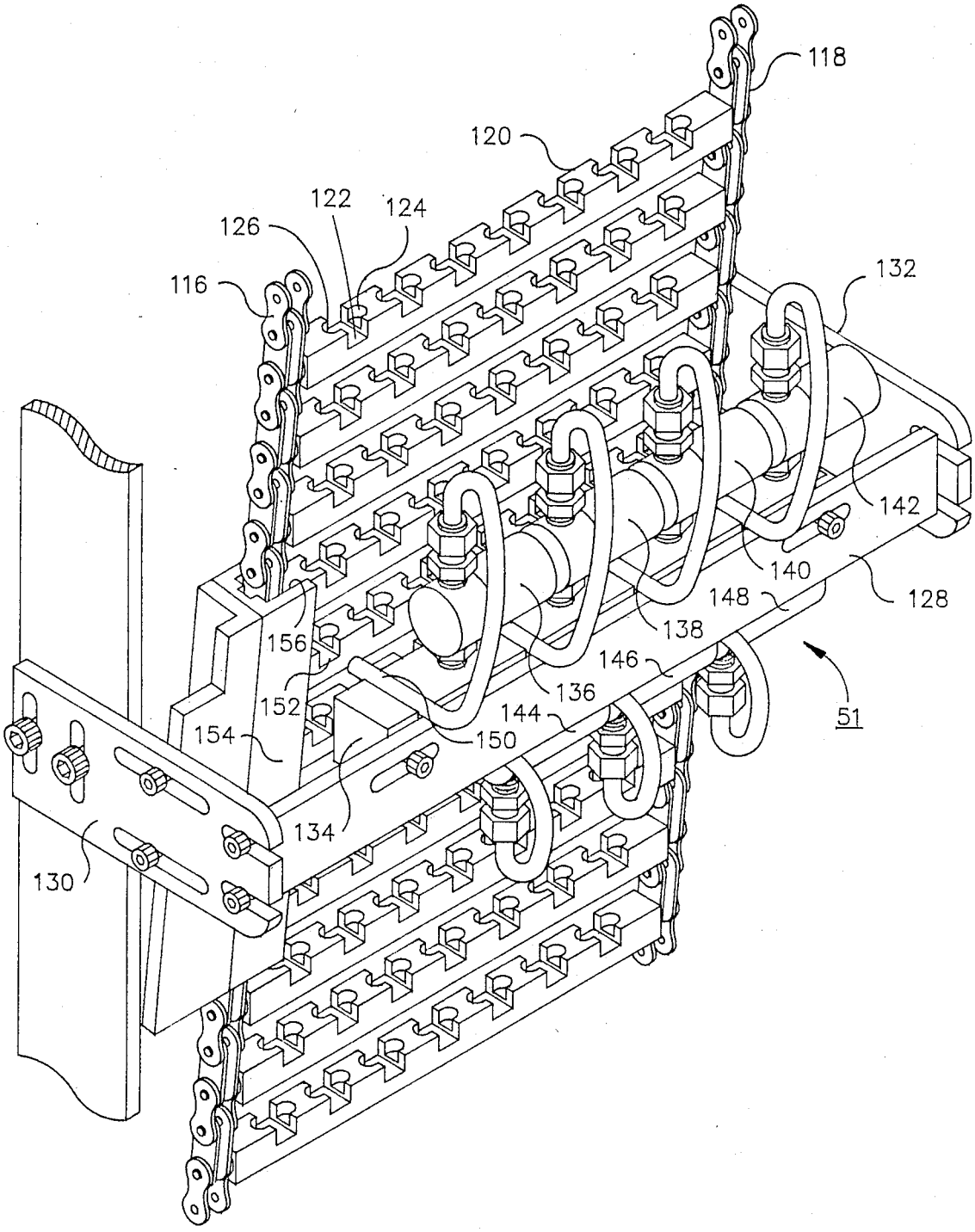
FIG. 6 is a fragmentary perspective view of a portion of the bucket conveyor, the bucket guides, and the capsule rejection mechanism including air manifold solenoid valves and nozzles.

The bucket conveyor, as shown in FIG. 6, comprises a pair of chains 116 and 118, which travel in parallel paths. Elongated buckets 120 extend from one chain to the other, and are pivoted to the chains and weighted so that their recesses normally face upwardly regardless of the direction of travel of the bucket conveyor. Each recess comprises a slot 122 with extensions 124 and 126 conforming to the shapes of the ends of a capsule. The slot extends a short distance below the extensions to provide clearance for the wet band of binder around the capsule. Each bucket has a number of slots (in this case seven) corresponding to the number of slots in each of the slats of the slat conveyor.

The air valve and nozzle array 51 is supported on bar 128 between brackets 130 and 132. The brackets are adjustably secured to frame members of the machine, and bar 128 is likewise adjustably secured to the brackets. An air manifold 134 is adjustably secured to bar 128, and supports sets of solenoid valves and nozzles. Adjustment of the brackets relative to the frame members, adjustment of bar 128 relative to the brackets, and adjustment of manifold 134 relative to bar 128 are accomplished by bolts and slots, which provide for universal adjustment of the positions of the array of air nozzles relative to the buckets. Solenoid valves 136, 138, 140 and 142 are located above manifold 134, and receive air under pressure from the manifold. Similarly, solenoid valves 144, 146 and 148 are located below and connected to the manifold. Each solenoid valve has its outlet connected to a nozzle. For example, valve 136 is connected to nozzle 150 and positioned to direct a stream of air toward the leftmost slot 152 in a bucket. The nozzles connected to the upper solenoid valves are directed toward the first, third, fifth and seventh bucket slots, while the nozzles connected to the lower solenoid valves are directed toward the second, fourth and sixth slots in a lower bucket.

A guide 154 has a slot 156 which receives ends of the buckets as they pass the air valve and nozzle array 51. Guide 154 prevents the buckets from tilting about their pivots under the force of the air delivered through the nozzles. This assures that the ejection assembly will not cause good capsules to be dumped, and also assures that defective capsules will be effectively ejected.

Figure 7:
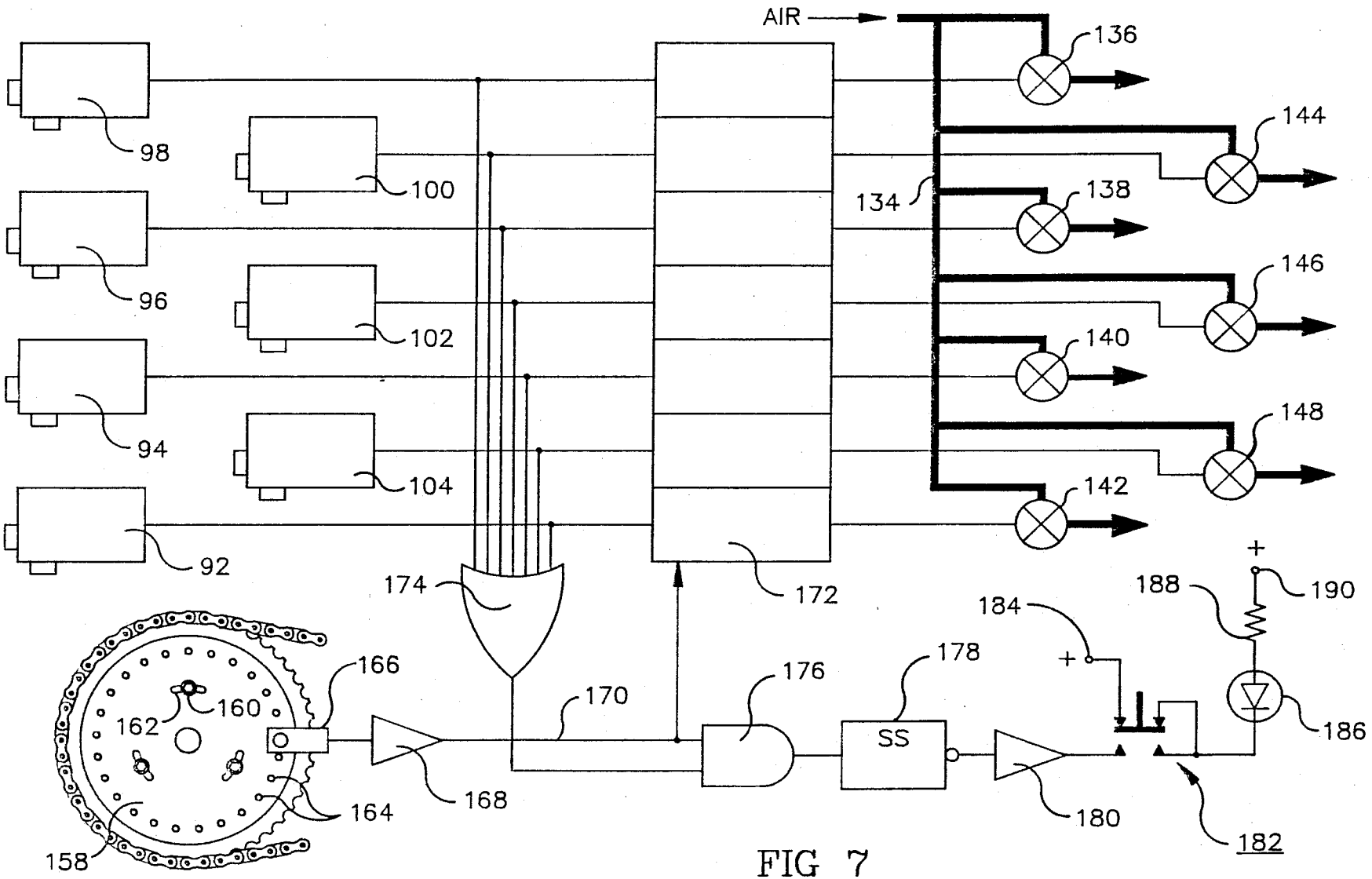
FIG. 7 is a schematic diagram of the inspection and rejection means, the shift register circuitry, and the circuitry for aiding in the alignment of the inspection head assembly with the slat conveyor.

Referring to FIG. 7, the apparatus has a timing wheel 158 (the position of which is shown in FIG. 1). The wheel rotates with the slat conveyor and with the bucket conveyor, which is synchronized with the slat conveyor. Timing wheel 158 is adjustably secured to a sprocket on a shaft of the slat conveyor by bolts extending through arcuate slots, one such bolt being indicated at 160 in slot 162. A photoelectric detector 166, receives pulses of light from a source (not shown) through holes 164 as timing wheel 158 rotates. The holes in the timing wheel are uniformly spaced in a circle. Detector 166 delivers an output signal through amplifier 168 to produce a clock signal in line 170. This clock signal serves as a clock for an array 172 of shift registers. Array 172 can be made up of integrated circuit shift registers or discrete electronic components. Preferably, however, the shift register array is constituted by a programmable controller such as a Series One Programmable Controller available from General Electric Company. A programmable controller can simulate a conventional shift register, and is preferred because of its greater flexibility.

The inspection heads 98–104 are conventional mark scanners. Each unit comprises an incandescent lamp and a lens which focusses light from the lamp onto a small rectangular spot (173 in FIG. 5) at a distance about twelve mm. from the lens. The inspection head also includes a photoelectric sensor which is responsive to light reflected back to the lens. By adjusting its sensitivity, each inspection head can be made to respond to chnges in color at the object on which the light beam is focussed. Thus, when it encounters a capsule seal which is sufficiently incomplete or otherwise sufficiently defective, an inspection head will produce an electrical signal indicating a defective seal. A suitable mark scanner is an ATC Model 7059A Mark Scanner available from Automatic Timing and Controls Co. of King of Prussia, Pa.

The shift register array in FIG. 7 receives signals from each of the inspection heads 98–104, and produces outputs, which control solenoid valves 136–142 to deliver air from manifold 134 selectively through the air nozzles for ejection of capsules having defective seals.

The signals delivered by the inspection heads are also connected to seven inputs of OR-gate 174, the output of which is connected along with the clock line 170 to inputs of a two input AND-gate 176. The output of the AND-gate is connected to a one shot multivibrator 178. The output of multivibrator 178 is connected through inverter 180 to the normally open contacts of a pushbutton switch 182. The normally closed contacts connect a positive supply terminal 184 to light-emitting diode 186, the anode of which is connected through a resistor 188 to another positive supply terminal 190.

The circuit which operates light-emitting diode 186 serves to indicate proper alignment of the inspection head array with the slots of the slat conveyor.

Before operation of the capsule-sealing machine commences, the inspection heads must be properly aligned with the capsule-retaining slots of the slats in the slat conveyor. Referring to FIG. 5, coarse adjustment of the position of inspection head-carrying bar 78 is accomplished by moving the slat conveyor until a slat is directly underneath the lenses of the inspection heads 92–98 and then passing a metal rod 192 downwardly through tube which has a vertical passage in a block between inspection heads 94 and 96. This passage is in line with the light beams of inspection heads 92–98. Bar 78 is moved from side to side by adjustment of wheel 112 until rod 192 can be pushed into the enlarged central part of the fourth slot in the slat. Rod 192 is then removed, and further adjustment is carried out using the electronic monitoring circuit depicted in FIG. 7. Rod 192 can remain in its block if a return spring or other suitable means are provided to keep its lower end normally above the slats.

With capsules being fed by the rectifying section to the binder application section, the sealing apparatus is operated for a brief period of time while pushbutton 182 is held down. Capsules carried by the slats can be inspected visually during this period, and defective capsules can be removed normally. Since the output of inverter 180 is normally in a low condition, LED 186 is continuously lit. If the inspection heads are properly aligned with the capsule-carrying slats, all seven inspection head outputs are in a low condition during each clock pulse, because the capsule-sealing bands are directly below the inspection head apertures as the clock pulses occur. Consequently, at all times, either the clock pulse input line 170 of AND-gate 176 is low, or the output of OR-gate 174 is low. When the inspection heads are properly adjusted, therefore, the output of AND-gate 176 remains in a low condition. The output of one shot 178 remains high, and the output of inverter 180 remains low, causing LED 186 to be steadily illuminated. However, if the inspection heads are misaligned with the slats, the outputs of one or more of the inspection heads go high when a clock pulse occurs. This causes one shot 178 to trigger, thereby causing LED 186 to flash.

While the sealing machine is operating, adjusting wheel 112 (FIG. 5) is operated until LED 186 is steadily illuminated. When this occurs, the operator can be certain that the inspection heads are properly aligned with the capsules. The rejection apparatus is disabled during adjustment of the inspection heads in order to prevent excessive numbers of capsules from being blown into reject receptacle 53.

In normal operation of the sealing machine, whenever a capsule with a sufficiently defective seal passes one of the inspection heads, the inspection head produces a pulse at its output, which is clocked through the corresponding shift register in array 172. The delay produced by the shift register is such that the shift register produces an output at the exact time the defectively sealed capsule reaches the point at which it can be ejected by the air nozzle corresponding to the inspection head which detected the defect. The capsule is blown off the bucket conveyor, and into receptacle 53 (FIG. 1).

The inspection system of the invention affords very reliable inspection of capsule seals at the high speeds at which the capsule-sealing machines operate. The number of defectively sealed capsules delivered to chute 46 (FIG. 1) is significantly lower than the number delivered to chute 46 with visual inspection. Operation of the inspection and rejection apparatus can be monitored electronically, and a monitoring system (not shown), responsive to the electrical signals produced by the inspection heads, can count defective seals, and indicate to the operator when adjustments or repairs are required. In addition, if desired, the monitoring electronics can automatically shut down the sealing machine when an excessive number of defects is detected.

The inspection heads can easily be moved away from the slat conveyor by lifting the carrier bar 78 in the L-shaped slots of the brackets. The carrier bar can be rotated in the triangular openings at the upper ends of the vertical slots and moved into the substantially horizontal slots, where the bar can remain while the slat conveyor is being cleaned or repaired. After cleaning or repair of the slats, the inspection head carrier bar can be returned to its initial position, and readjusted, if necessary, with the aid of monitoring LED 186.

The principal advantage of the invention is that the inspection and rejection components are all incorporated into the capsule-sealing and drying mechanism, with the inspection heads located above the upper run of the slat conveyor, and with the air nozzles of the rejection apparatus located adjacent to a generally vertical run of the dryer buckets. The resultant structure is simple, easily used, and highly reliable.

Numerous modifications can be made to the invention described herein. For example, the inspection heads can be in a single row if narrower inspection heads are used or if the slots of the slat conveyor are farther apart. Instead of producing narrow beams, the inspection heads can produce broad beams and have their photoelectric detectors focussed so that they are responsive only to light reflected from small well-defined areas. The shift register array need not be simulated by a programmable controller, as conventional integrated circuit shift registers can be used. Instead of a threaded shaft fixed to the adjusting wheel 112, the wheel can have a central hole threaded onto a threaded shaft fixed to and extending outwardly from bracket 50. The spacing between the upper and lower rows of air nozzles at the capsule rejection station need not be equal to the interval between the two rows of inspection beams, as differences in spacing can be accommodated by using appropriate numbers of stages in the shift registers. This is particularly easy to accomplish when the shift register are simulated by a programmable controller. Other modifications can be made to the inspection and rejection apparatus of the invention without departing from the scope of the invention as defined by the following claims.

We claim:

1. In combination with a machine for sealing two-part oblong capsules, each capsule having a first smaller diameter open-ended part and a second larger diameter open-ended part overlapping the smaller diameter part, the machine comprising: a first endless conveyor having a series of slats, each slat having a row of capsule-receiving slots, the row extending in a direction transverse to the conveyor path and the slots being elongated in said direction; liquid binder applying means disposed along the path of the first conveyor for transferring liquid binder to the circumference of the capsules carried by the conveyor to form a narrow band of liquid binder at the edge of the opening of each larger diameter part; means for drying the binder on the capsules comprising a second endless conveyor having a series of capsule-carrying buckets, a drying chamber, and means for guiding the buckets through the drying chamber; means for transfer of capsules from the conveyor to the drying means; and means for removing dried capsules from the second conveyor;

an inspection and rejection apparatus comprising:

photoelectric inspection means adjacent to the portion of the first conveyor in the path between the binder applying means and the transfer means, said photoelectric inspection means comprising means for producing a defect signal upon detection of a capsule having a defective band of liquid binder;

rejection means, located adjacent to the portion of the second conveyor in the path between the transfer means and the means for removing dried capsules, for removing selected capsules from the capsule-carrying buckets of the second conveyor; and control means responsive to defect signals produced by the photoelectric inspection means for causing the removing means to remove capsules defective bands on which caused the inspection means to produce the defect signals;

in which each capsule-carrying bucket of the second conveyor has a row of capsule-receiving recesses, and in which the means for removing selected capsules comprises a plurality of air nozzles, there being one air nozzle adjacent to the path of each recess, the nozzle being arranged to project a short-duration stream of air toward a recess as it passes the nozzle to blow a capsule out of the recess; and in which the second conveyor comprises a pair of conveyor chains and in which each capsule-carrying bucket is carried between the pair of conveyor chains and rotatable about a horizontal axis extending between the conveyor chains, and in which each bucket is weighted so that the openings of its recesses normally face upwardly and having guide means, located adjacent to the means for removing selected capsules, for restraining said buckets against rotation as they pass the air nozzles, whereby the air streams projected by said nozzles are prevented from causing rotation of the buckets.

2. In combination with a machine for sealing two-part oblong capsules, each capsule having a first smaller diameter open-ended part and a second larger diameter open-ended part overlapping the smaller diameter part, the machine comprising: a first endless conveyor having a series of slats, each slat having a row of capsule-receiving slots, the row extending in a direction transverse to the conveyor path and the slots being elongated in said direction; liquid binder applying means disposed along the path of the first conveyor for transferring liquid binder to the circumference of the capsules carried by the conveyor to form a narrow band of liquid binder at the edge of the opening of each larger diameter part; means for drying the binder on the capsules comprising a second endless conveyor having a series of capsule-carrying buckets, a drying chamber, and means for guiding the buckets through the drying chamber; means for transfer of capsules from the conveyor to the drying means; and means for removing dried capsules from the second conveyor;

an inspection and rejection apparatus comprising:

photoelectric inspection means adjacent to the portion of the first conveyor in the path between the binder applying means and the transfer means, said photoelectric inspection means comprising means for producing a defect signal upon detection for a capsule having a defective band of liquid binder;

rejection means, located adjacent to the portion of the second conveyor in the path between the transfer means and the means for removing dried capsules, for removing selected capsules from the capsule-carrying buckets of the second conveyor; and control means responsive to defect signals produced by the photoelectric inspection means for causing the removing means to remove capsules defective bands on which caused the inspection means to produce said defect signals;

in which the photoelectric inspection means comprises a first row of inspection heads positioned to inspect capsules in a first group of slots in a slat when the slat reaches a first station along the path of the first conveyor, and a second row of inspection heads positioned to inspect capsules in a second group of slots in the same slat when the slat reaches a second station along the path of the first conveyor, and in which the means for removing selected capsules comprises a first row of air nozzles, each nozzle in the first row being positioned to project short-duration streams of air toward a recess in a first group of recesses in a bucket when the bucket reaches a first station in the path of the second conveyor and a second row of air nozzles, each nozzle in the second row being positioned to project a short duration stream of air toward a recess in a second group of recesses in the same bucket when the bucket reaches a second station in the path of the second conveyor, and in which the inspection heads and nozzles are arranged so that said first and second groups of slots in the slat are interleaved and so that said first and second groups of recesses in the bucket are interleaved.

3. In combination with a machine for sealing two-part oblong capsules, each capsule having a first smaller diameter open-ended part and a second larger diameter open-ended part overlapping the smaller diameter part, the machine comprising: a first endless conveyor having a series of slats, each slat having a row of capsule-receiving slots, the row extending in a direction transverse to the conveyor path and the slots being elongated in said direction; liquid binder applying means disposed along the path of the first conveyor for transferring liquid binder to the circumference of the capsules carried by the conveyor to form a narrow band of liquid binder at the edge of the opening of each larger diameter part; means for drying the binder on the capsules comprising a second endless conveyor having a series of capsule-carrying buckets, a drying chamber, and means for guiding the buckets through the drying chamber, means for transfer of capsules from the conveyor to the drying means; and means for removing dried capsules from the second conveyor;

an inspection and rejection apparatus comprising:

photoelectric inspection means adjacent to the portion of the first conveyor in the path between the binder applying means and the transfer means, said photoelectric inspection means comprising means for producing a defect signal upon detection of a capsule having a defective band of liquid binder;

rejection means, located adjacent to the portion of the second conveyor in the path between the transfer means and the means for removing dried capsules, for removing selected capsules from the capsule-carrying buckets of the second conveyor; and control means responsive to defect signals produced by the photoelectric inspection means for causing the removing means to remove capsules defective bands on which caused the inspection means to produce said defect signals;

in which the photoelectric inspection means comprises an elongated supporting bar, a plurality of photoelectric inspection heads fixed to and supported by the bar, each head having means for producing a beam and means for detecting reflection of said beam by a narrow portion of a capsule, there being one inspection heads on the bar for each of the capsule-receiving slots in said row, and means for supporting the bar adjacent to the the first conveyor so that it extends transverse to the direction of movement of said first conveyor and so that the beams produced by the inspection heads on the bar are directed toward the paths of the capsule-receiving slots; and including means for moving the supportin bar relative to the bar-supporting means along a line parallel to the elongation of the slots for fine adjustment of the positions of the inspection heads relative to the paths of the capsule-receiving slots.

4. The combination according to claim 3 in which the means for supporting the bar comprises a first bracket having a plate situated in a vertical plane on one side of the first conveyor and a second bracket having a plate situated in a vertical plane on the opposite side of the first conveyor, said plates having slots receiving said bar and allowing the bar to be moved upwardly away from its position adjcent to the first conveyor, and means on said brackets for temporarily supporting the bar in a position remote from said position adjacent to the first conveyor.

5. The combination according to claim 4 in which the slots are inverted L-shaped slots, and in which the means for temporarily supporting the bar are substantially horizontally extending portions of said slots.

6. The combination according to claim 3 in which the supporting bar has a notch near one of its ends, said notch extending inwardly from an edge of the bar in a direction perpendicular to its direction of elongation and having opposed sides, and in which the means for moving the supporting bar comprises a wheel positioned to enter said notch and to engage both opposed sides of the notch, means supporting the wheel on the bar-supporting means so that the wheel axis is parallel to the direction of elongation of the bar, and threaded means for effecting axial movement of the wheel upon rotation of the wheel, whereby the position of the bar along said line parallel to the elongation of the slots can be adjusted by rotation of the wheel.

7. The combination according to claim 6 having releasable locking means for engaging the bar and preventing it from moving relative to the bar-supporting means in said direction of elongation of the bar.

8. The combination of claim 3 in which the means for supporting the bar comprises a first bracket having a plate situated in a vertical plane on one side of the first conveyor and a second bracket having a plate situated in a vertical plane on the opposite side of the first conveyor, said plates having slots receiving said bar and allowing the bar to be moved upwardly away from its position adjacent to the first conveyor, and in which the supporting bar has a lower edge and a notch near one of its ends, said notch extending upwardly from said lower edge of the bar in a direction perpendicular to the direction of elongation of the bar, said notch having opposed sides, and in which the means for moving the supporting bar comprises a wheel positioned to enter said notch and to engage both opposed sides of the notch, means supporting the wheel on one of said brackets so that the wheel axis is parallel to the direction of elongation of the bar, and threaded means for effecting axial movement of the wheel upon rotation of the wheel, whereby the position of the bar along said line parallel to the elongation of the slots can be adjusted by rotation of the wheel, said bar being disengageable from the wheel by upward movement of the bar in said slots.

9. The combination of claim 8 having releasable locking means for preventing the bar from moving relative to the bar-supporting means in said direction of elongation of the bar, said locking means being a single locking screw.

10. In combination with a machine for sealing two-part oblong capsules, each capsule having a first smaller diameter open-ended part and second larger diameter open-ended part overlapping the smaller diameter part, the machine comprising: a first endless conveyor having a series of slats, each slat having a row of capsule-receiving slots, the row extending in a direction transverse to the conveyor path and the slots being elongated in said direction; liquid binder applying means disposed along the path of the first conveyor for transferring liquid binder to the circumference of the capsules carried by the conveyor to form a narrow band of liquid binder at the edge of the opening of each larger diameter part; means for drying the binder on the capsules comprising a second endless conveyor having a series of capsule-carrying buckets, a drying chamber, and means for guiding the buckets through the drying chamber; means for transfer of capsules from the conveyor to the drying means; and means for removing dried capsules from the second conveyor;

an inspection and rejection apparatus comprising:

photoelectric inspection means adjacent to the portion of the first conveyor in the path between the binder applying means and the transfer means, said photoelectric inspection means comprising means for producing a defect signal upon detection of a capsule having a defective band of liquid binder;

rejection means, located adjacent to the portion of the second conveyor in the path between the transfer means and the means for removing dried capsules, for removing selected capsules from the capsule-carrying buckets of the second conveyor; and control means responsive to defect signals produced by the photoelectric inspection means for causing the removing means to remove capsules defective bands on which caused the inspection means to produce said defect signals;

including means for adjusting the position of the photoelectric inspection means laterally relative to the direction of movement of said first endless conveyor, and means responsive to signals produced by said photoelectric means for indicating misalignment of the photoelectric inspection means with the paths of the capsules carried by said first endless conveyor.

11. In combination with a machine for sealing two-part oblong capsules, each capsule having a first smaller diameter open-ended part and a second larger diameter open-ended part overlapping the smaller diameter part, the machine comprising: a first endless conveyor having a series of slats, each slat having a row of capsule-receiving slots, the row extending in a direction transverse to the conveyor path and the slots being elongated in said direction; liquid binder applying means disposed along the path of the first conveyor for transferring liquid binder to the circumference of the capsules carried by the conveyor to form a narrow band of liquid binder at the edge of the opening of each larger diameter part; means for drying the binder on the capsules comprising a second endless conveyor having a series of capsule-carrying buckets, a drying chamber, and means for guiding the buckets through the drying chamber; means for transfer of capsules from the conveyor to the drying means; and means for removing dried capsules from the second conveyor;

an inspection and rejection apparatus comprising:

photoelectric inspection means adjacent to the portion of the first conveyor in the path between the binder applying means and the transfer means, said photoelectric inspection means comprising means for producing a defect signal upon detection for a capsule having a defective band of liquid binder;

rejection means, located adjacent to the portion of the second conveyor in the path between the transfer means and the means for removing dried capsules, for removing selected capsules from the capsule-carrying buckets of the second conveyor; and control means responsive to defect signals produced by the photoelectric inspection means for causing the removing means to remove capsules defective bands on which caused the inspection means to produce said defect signals;

in which the photoelectric inspection means comprises an elongated supporting bar, a plurality of photoelectric inspection heads fixed to and supported by the bar each head having means for producing a beam and means for detecting reflection of said beam by a narrow portion of a capsule and means for producing an output signal whenever the sealing band of a capsule is not located in a position to reflect the beam to the detecting means, there being one inspection head on the bar for each of the capsule-receiving slots in said row, and means for supporting the bar adjacent to the first conveyor so that it extends transverse to the direction of the movement of said first conveyor and so that the beams produced by the inspection heads on the bar are directed toward the paths of the capsule-receiving slots; and including means for moving the supporting bar relative to the bar-supporting means along a line parallel to the elongation of the slots for fine adjustment of the positions of the inspection heads relative to the paths of the capsule-receiving slots, means for producing clock pulses as the slots of the slats pass the beams, gating means, connected to receive said clock pulses and output signals from said photoelectric inspection heads, for producing a signal when any of the photoelectric inspection means produces an output signal coincident with a clock pulse, and indicating means responsive to signals produced by said gating means, whereby alignment of the photoelectric inspection means can be accomplished during operation of the machine by fine adjustment of the positions of the inspection heads relative to the paths of the capsule-receiving slots until the gating means stops producing output signals.

* * * * *